US010327283B2

(12) United States Patent
Kim et al.

(10) Patent No.: US 10,327,283 B2
(45) Date of Patent: Jun. 18, 2019

(54) HOME APPLIANCE

(71) Applicant: LG ELECTRONICS INC., Seoul (KR)

(72) Inventors: Euisung Kim, Seoul (KR); Sunyoung Park, Seoul (KR); Sungyong Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 326 days.

(21) Appl. No.: 15/123,954

(22) PCT Filed: Jun. 19, 2015

(86) PCT No.: PCT/KR2015/006237
§ 371 (c)(1),
(2) Date: Sep. 6, 2016

(87) PCT Pub. No.: WO2015/199382
PCT Pub. Date: Dec. 30, 2015

(65) Prior Publication Data

US 2017/0019952 A1 Jan. 19, 2017

(30) Foreign Application Priority Data

Jun. 26, 2014 (KR) ..... 10-2014-0079011
Apr. 22, 2015 (KR) ..... 10-2015-0056461

(51) Int. Cl.
*H05B 3/60* (2006.01)
*H05B 1/02* (2006.01)
(Continued)

(52) U.S. Cl.
CPC ..... *H05B 1/0283* (2013.01); *H05B 1/0244* (2013.01); *H05B 6/06* (2013.01); *H05B 6/108* (2013.01); *H05B 6/365* (2013.01)

(58) Field of Classification Search
None
See application file for complete search history.

(56) References Cited

U.S. PATENT DOCUMENTS 1,418,011 A * 5/1922 Mehn ..... F24H 1/162 122/4 A
2,116,896 A * 5/1938 Hudson ..... F24H 1/162 165/168
(Continued)

FOREIGN PATENT DOCUMENTS

CN 102458599 5/2012
CN 102645016 8/2012
(Continued)

OTHER PUBLICATIONS

Korean Office Action dated Oct. 25, 2016 issued in Application No. 10-2015-0056461.
(Continued)

*Primary Examiner* — Thor S Campbell
(74) *Attorney, Agent, or Firm* — Ked & Associates, LLP

(57) ABSTRACT

The present disclosure relates to a home appliance. The home appliance includes a dispensing port, a heating flow path part communicating with the dispensing port, a heating device for heating water flowing through the heating flow path part, and a controller controlling the heating device. The heating device includes a coil part in which coils are stacked in multilayers.

27 Claims, 6 Drawing Sheets

(51) Int. Cl.

| | |
|---|---|
| ***H05B 6/06*** | (2006.01) |
| ***H05B 6/10*** | (2006.01) |
| ***H05B 6/36*** | (2006.01) |

(56) References Cited

U.S. PATENT DOCUMENTS

| | | | | |
|---|---|---|---|---|
| 2,513,779 | A | 2/1948 | Bailey | |
| 3,031,563 | A * | 4/1962 | Koester, Jr. | F24H 1/142 122/208 |
| 4,065,057 | A * | 12/1977 | Durmann | B05B 7/1626 239/133 |
| 4,358,664 | A * | 11/1982 | Kronseder | B05C 9/14 392/479 |
| 4,847,470 | A * | 7/1989 | Bakke | A61M 5/44 392/470 |
| 4,866,250 | A * | 9/1989 | Pasbrig | F02M 31/125 392/479 |
| 5,138,693 | A * | 8/1992 | Knauss | A47J 27/024 134/107 |
| 7,920,779 | B2 * | 4/2011 | Shirai | E03D 9/08 392/465 |
| 8,938,845 | B2 * | 1/2015 | Grandjean | B60S 1/488 15/250.01 |
| 2001/0009610 | A1 * | 7/2001 | Augustine | A61M 5/44 392/470 |
| 2012/0057857 | A1 * | 3/2012 | Kenney | F24H 1/142 392/465 |
| 2012/0073518 | A1 | 3/2012 | Kang et al. | |
| 2013/0202279 | A1 * | 8/2013 | Reichl | A47J 31/542 392/480 |
| 2015/0034631 | A1 | 2/2015 | Kohl et al. | |

FOREIGN PATENT DOCUMENTS

| | | |
|---|---|---|
| CN | 203196439 U | 9/2013 |
| DE | 10 2012 206 603 | 10/2013 |
| JP | S52-016254 | 5/1977 |
| JP | H 04-070958 | 6/1992 |
| JP | H 06-088642 | 3/1994 |
| JP | H 06-123486 | 5/1994 |
| JP | H 09-314310 | 12/1997 |
| JP | H10-079294 | 3/1998 |
| JP | 2000-154938 | 6/2000 |
| JP | 2005-026162 | 1/2005 |
| JP | 2009/002616 | 1/2009 |
| JP | 2010-071548 | 4/2010 |
| JP | 2011-220598 | 11/2011 |
| KR | 20-0394155 | 8/2005 |
| KR | 10-2009-0013356 | 2/2009 |
| KR | 10-0956582 | 5/2010 |
| KR | 10-2010-0131803 | 12/2010 |
| KR | 10-2011-0000880 | 1/2011 |
| KR | 10-2011-0096868 | 8/2011 |
| KR | 10-2013-0047783 | 5/2013 |
| KR | 10-2014-0057184 | 5/2014 |
| WO | WO 2008/007819 | 1/2008 |

OTHER PUBLICATIONS

Japanese Office Actin dated Feb. 6, 2018 issued in Application No. 2017-507666.

European Search Report dated Feb. 26, 2018 issued in Application No. 15812144.2.

International Search Report and Written Opinion dated Sep. 25, 2015 issued in Application No. PCT/KR2015/006237 (full English text).

Korean Office Action dated Apr. 8, 2016 issued in Application No. 10-2015-0056461.

Korean Office Action dated Oct. 17, 2017 issued in Application No. 10-2015-0056461.

Japanese Office Action dated Oct. 31, 2017 issued in Application No. 2017-507666.

Korean Office Action dated Apr. 7, 2017 issued in Application No. 10-2015-0056461.

European Search Report dated Jul. 5, 2018 issued in Application No. 15812144.2.

Chinese Office Action dated Jul. 9, 2018 issued in Application No. 201580012295.7 (with English translation).

* cited by examiner

[Fig. 1]
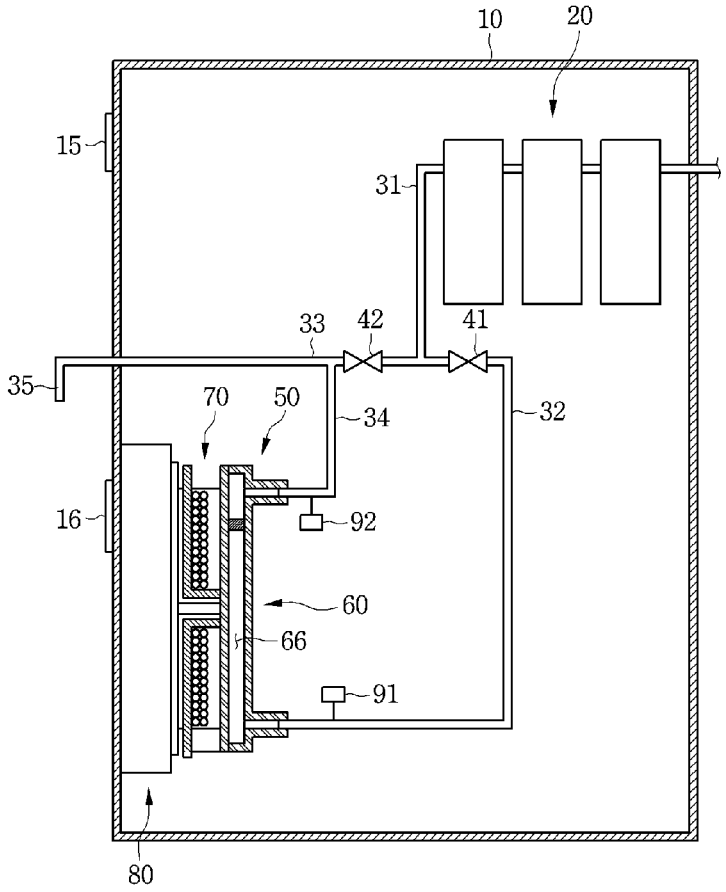

[Fig. 2]
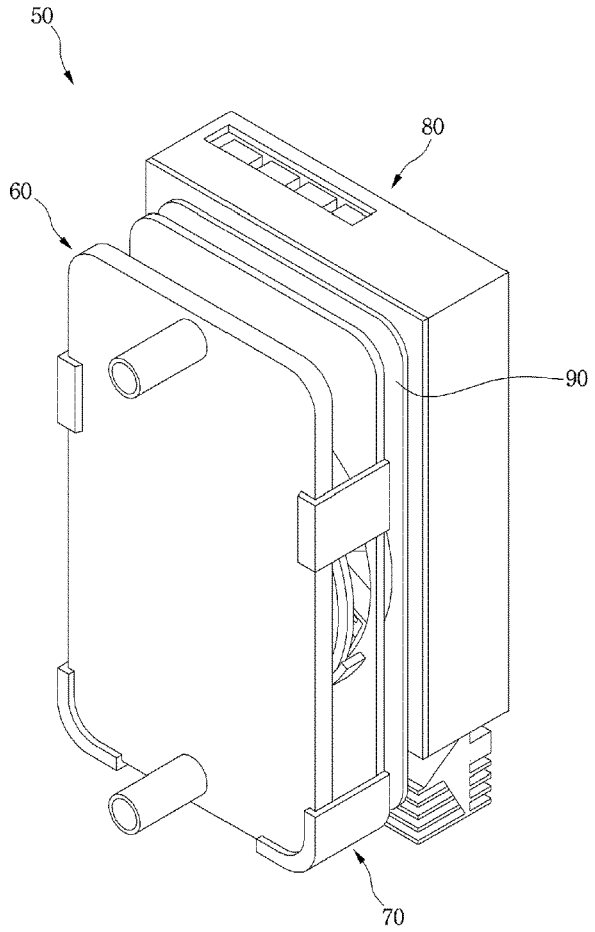
[Fig. 3]
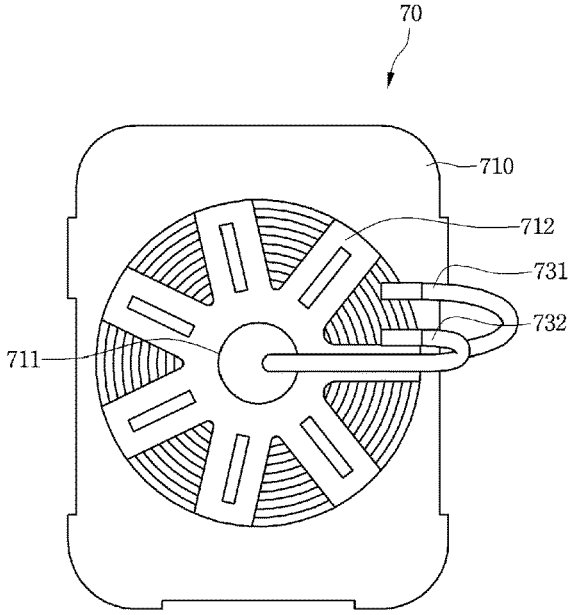

[Fig. 4]
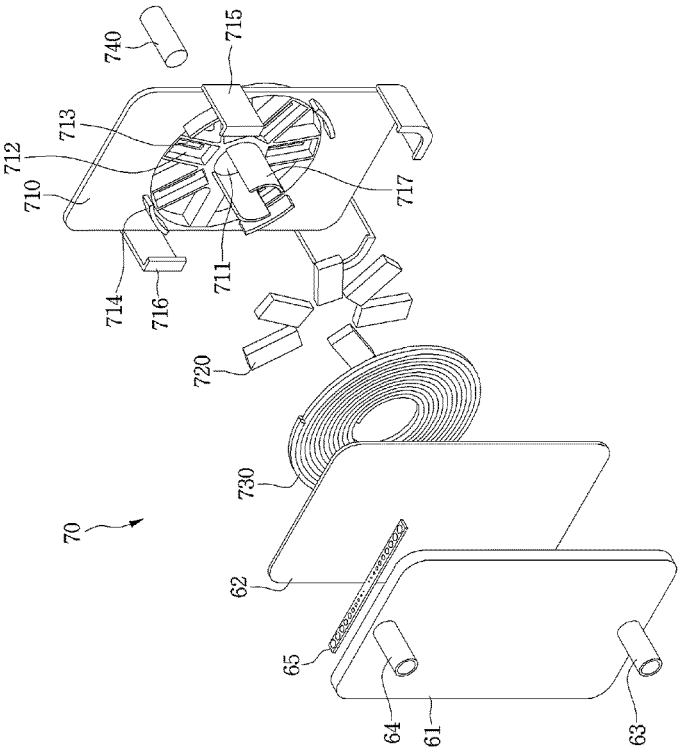
[Fig. 5]
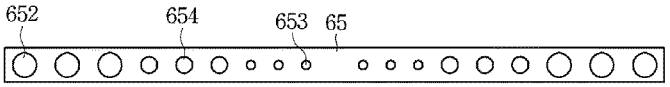
[Fig. 6]
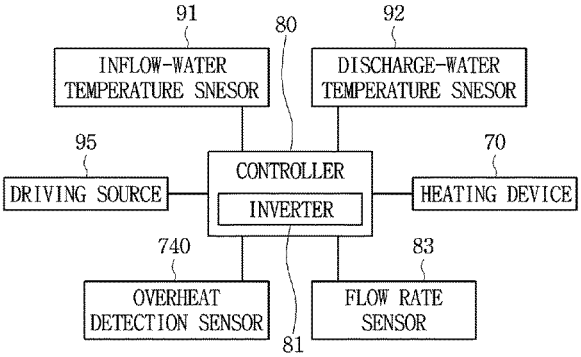
[Fig. 7]
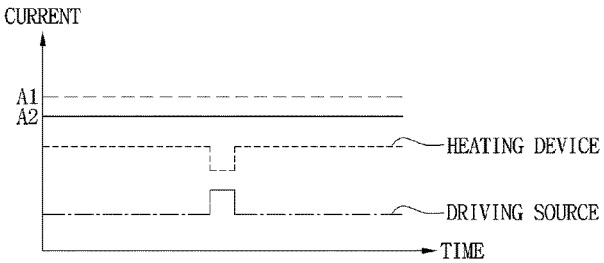

[Fig. 8]
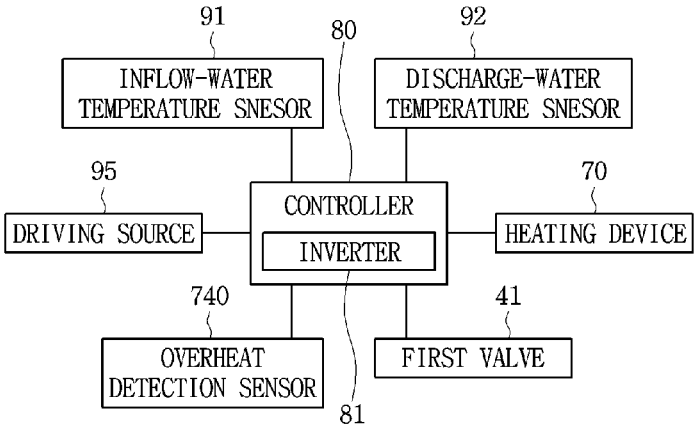
[Fig. 9]
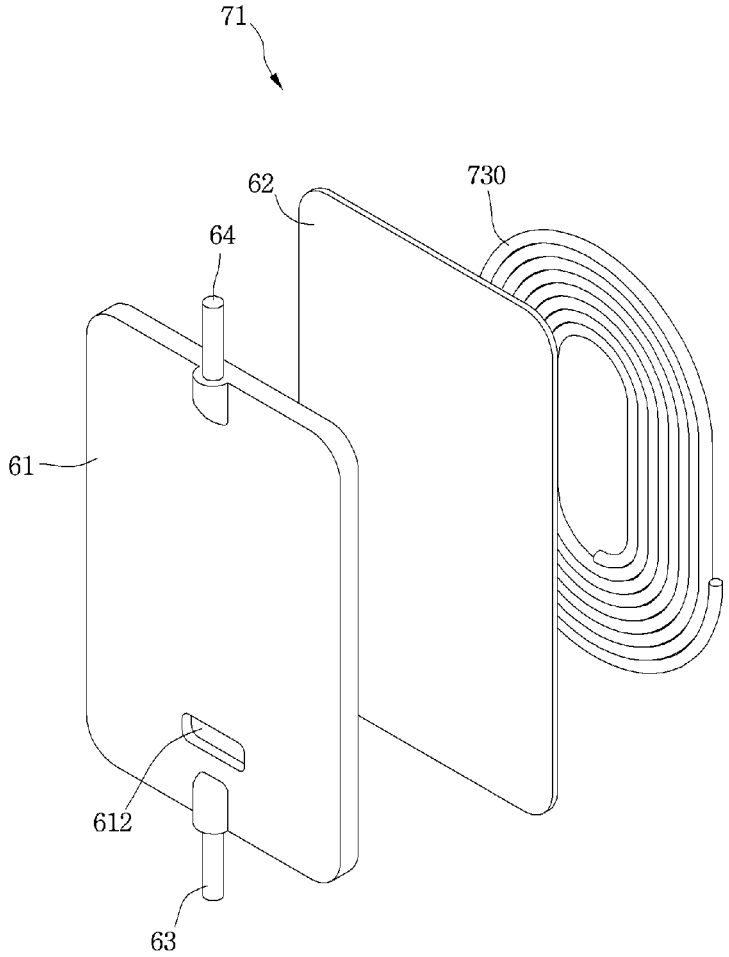

[Fig. 10]
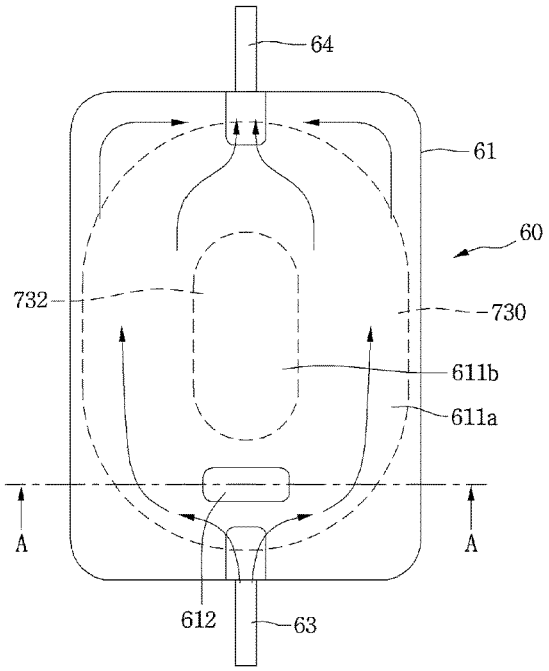
[Fig. 11]
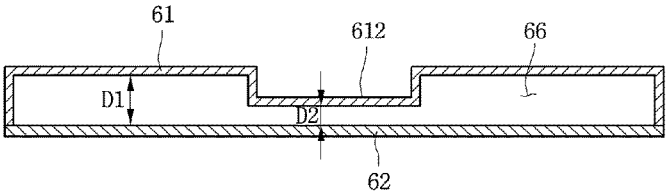
[Fig. 12]
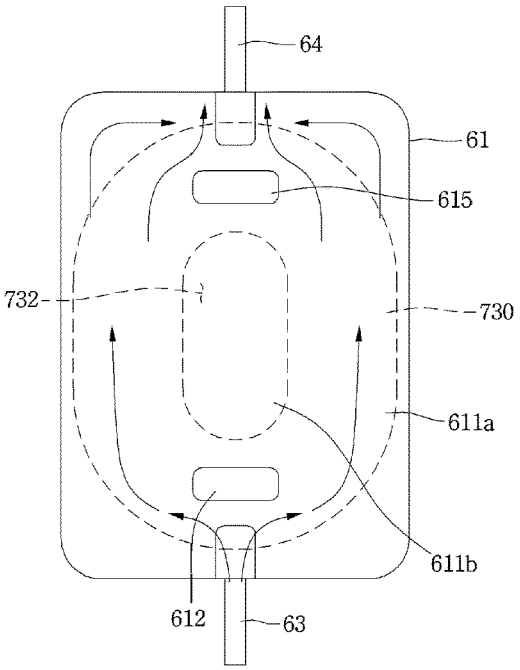

[Fig. 13]
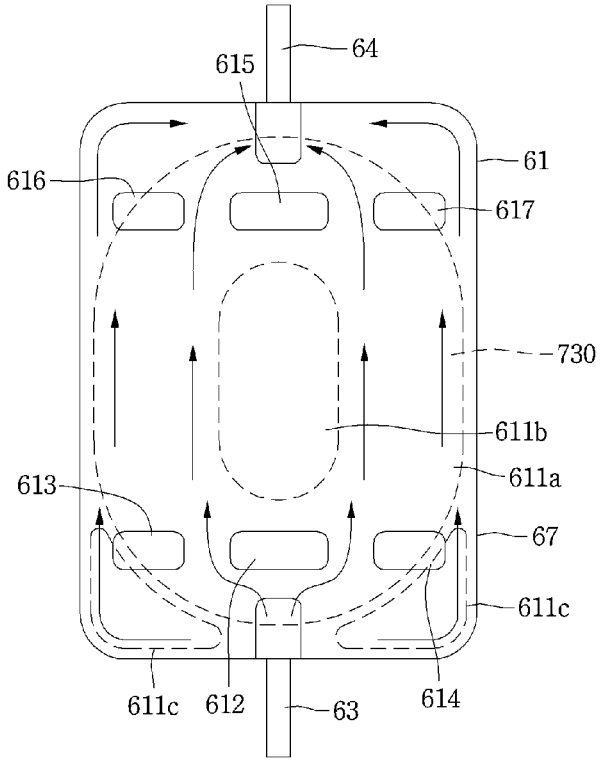
[Fig. 14]
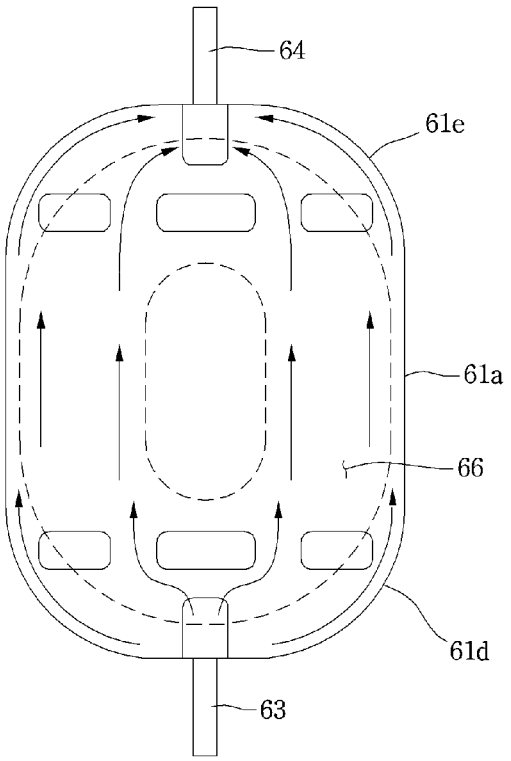

HOME APPLIANCE

CROSS-REFERENCE TO RELATED PATENT APPLICATIONS

This application is a U.S. National Stage Application under 35 U.S.C. § 371 of PCT Application No. PCT/KR2015/006237, filed Jun. 19, 2015, which claims priority to Korean Patent Application No. 10-2014-0079011, filed Jun. 26, 2014, and Korean Patent Application No. 10-2015-0056461, filed Apr. 22, 2015, whose entire disclosures are hereby incorporated by reference.

TECHNICAL FIELD

The present disclosure relates to a home appliance.

BACKGROUND ART

Water purifiers among home appliances are apparatuses for purifying introduced water to supply the purified water to users.

A prior document, Korean Utility Application Laid-Open Publication No. 2011-000088, published on Jan. 27, 2011, discloses a water purifier.

The water purifier includes a space part, a storage container allowed to be located at the space part, and a heating source capable of heating water contained in the storage container.

According to the water purifier disclosed in the prior document, since the heating source may heat water contained in the storage container, a user may not dispense hot water through a connection tube unless the user fills the storage container with water and locates the storage container at the space part. Therefore, the user may feel inconvenience.

DISCLOSURE OF INVENTION

Technical Problem

Embodiments provide a home appliance in which a temperature of dispensed hot water is adjusted, and an instantaneous water heater for generating hot water is compact.

Embodiments also provide a home appliance in which generation of steam according to local overheating of water in a heating flow path is prevented.

Solution to Problem

According to one embodiment, a home appliance includes: a dispensing port; a heating flow path part communicated with the dispensing port; a heating device configured to heat water flowing through the heating flow path part; and a controller configured to control the heating device, wherein the heating device includes a coil part in which coils are stacked in multilayers.

Also, the heating device may include frame on which the coil part is seated, and the frame may be coupled to the heating flow path part.

Also, the frame may include spacer spacing the heating flow path part from the coil part in a predetermined distance.

Also, the home appliance may further include a sensor to detect a temperature of the heating flow path part, wherein the sensor may be disposed within a region defined by the coil part.

Also, the frame may include an opening through which one or more of an input end and an output end of the coil part pass, and the sensor may be disposed in the opening.

Also, the heating flow path part may include: a first guide including an inflow part and discharge part; and a second guide coupled to the first guide and defining a heating flow path through which water flows together with the first guide, and the second guide may be a magnetic substance.

Also, a flow path guide for guiding flow of the water may be disposed in the heating flow path so that the water uniformly flows in an entire section of the flow path.

Also, the home appliance may further include a sensor to detect a temperature of hot water discharged from the heating flow path and an input part for inputting a temperature of the water dispensed from the dispensing hole. The controller may include an inverter for adjusting current applied to the coil part so that the temperature inputted through the input part is the same as the temperature detected in the sensor.

According to another embodiment, a home appliance includes: a dispensing port; a heating flow path part communicated with the dispensing port; a heating device configured to heat water flowing through the heating flow path part; and a controller configured to control the heating device, wherein the heating flow path part includes: an inflow part to which water is introduced; a discharge part from which the heated water is discharged; and a heating flow path connecting the inflow part to the discharge part, wherein a flow path guide for guiding flow of the water is disposed in the heating flow path so that the water uniformly flows between the inflow part and the discharge part.

Also, the flow path guide may include a plurality of holes through which the water passes, and the plurality of holes may be arranged in a direction crossing a direction in which the water flows in the heating flow path. Also, the plurality of holes may include: a first hole defined adjacent to an end of the flow path guide; and a second hole defined adjacent to a central side of the flow path guide, the second hole has a size different from that of the first hole.

Also, the second hole may be defined adjacent to the discharge part when compared to the first hole.

Also, the flow path guide may be disposed adjacent to the discharge part when compared to the inflow part.

Also, the flow path guide may be defined in the heating flow path part by a forming process.

Also, the heating flow path part may include: a first guide; and a second guide defining the heating flow path together with the first guide, and the flow path guide may extend from the first guide toward the second guide and is spaced apart from the second guide.

Also, the flow path guide may be disposed on a line connecting the inflow part to the discharge part in the heating flow path so as to change a flow direction of the water introduced from the inflow part.

Also, the heating device may include a coil part having a ring shape, and the heating flow path part may include: a first portion facing the coil part; and a second portion not facing the coil part, and the flow path guide may guide the flow of the water so that the water introduced from the inflow part flows toward the first portion.

Also, the flow path guide may be disposed between the second portion and the inflow part.

Also, a plurality of flow path guides may be isposed to be spaced apart from each other in a direction parallel to the flow direction of the water between the inflow part and the discharge part.

Also, the plurality of flow path guides may include: a first flow path guide; and a second flow path guide disposed in a region between the first flow path guide and the discharge part.

Also, a plurality of flow path guides may be arranged in a direction crossing the flow direction of the water between the inflow part and the discharge part.

Also, a distance between two adjacent flow path guides may be greater than a distance between one flow path guide adjacent to a side wall of the heating flow path part and a side wall of the heating flow path part.

Also, the heating flow path part may include a pair of corner parts allowing the heating flow path to gradually decrease in section area as the heating flow path is away from the inflow part, and each of the pair of corner parts may be rounded or inclined, and the discharge part may be disposed between the pair of corner parts.

According to another embodiment, a home appliance includes: a dispensing port; a heating flow path part communicating with the dispensing port; a heating device for heating water flowing through the heating flow path part; an input part for inputting a temperature of water dispensed from the dispensing port; and a controller adjusting current applied to the coil part according to the temperature inputted through the input part.

Also, the home appliance may further include a discharge-water temperature sensor to detect a temperature of hot water discharged from the heating flow path part, wherein the controller may adjust the current applied to the coil part so that the temperature inputted from the input part is the same as the temperature detected from the discharge-water temperature sensor.

Also, the home appliance may further include an driving source operating by receiving current, wherein the controller may control current of the driving source according to the current supplied to the heating device.

Also, the home appliance may further include: an inflow-water temperature sensor to detect a temperature of water supplied to the heating flow path part; a flow rate sensor to detect a flow rate of the water supplied to the heating flow path part; and a discharge-water temperature sensor to detect a temperature of hot water discharged from the heating flow path part, wherein, in an initial operation stage of the heating device, the controller may determine a current value to be supplied to the coil part on the basis of information detected from the inflow-water temperature sensor and the flow rate sensor to apply the determined current value, and while the heating device operates, the controller may adjust current supplied to the coil part on the basis of the temperature detected from the discharge-water temperature sensor.

Also, the home appliance may further include: an inflow-water temperature sensor to detect a temperature of water supplied to the heating flow path part; and a valve for adjusting a flow rate of water supplied to the heating flow path part, wherein, in an initial operation stage of the heating device, the controller may determine a flow rate of water to be supplied to the heating flow path part on the basis of a temperature of water detected in the inflow-water temperature sensor to control the valve so that the determined flow rate of water is supplied to the heating flow path part.

Also, the home appliance may further include a discharge-water temperature sensor to detect a temperature of hot water discharged from the heating flow path part, wherein, in an initial operation stage of the heating device, the controller may supply a preset amount of current to the coil part and adjusts current applied to the coil part according to the temperature detected in the discharge-water temperature sensor.

Also, the controller may be disposed on one side of the heating device, and a shield plate for preventing the controller from being affected by a magnetic field of the coil part may be disposed between the heating device and the controller.

Advantageous Effects of Invention

According to exemplary embodiments, since the coil are stacked in multilayers, the heating device may be compact.

Also, since the heating device heats water flowing through the heating flow path part, standby power for storing hot water is not necessary.

Also, since the heating flow path part heats water flowing through the heating flow path by inductive heating, water in the heating flow path may be quickly heated without losing a heat source.

Also, since a surface of a magnetic substance of the heating flow path part generates heat, peripheral temperatures do not increase, and thus, the heat insulation of the heating flow path part is not necessary.

Also, since water may flow entirely in the cross-section of the heating flow path as the heating flow path includes a flow path guide, water may be quickly heated.

Also, since the water uniformly flows in the heating flow path, generation of steam from one position in the heating flow path due to local overheating may be prevented.

Also, since a user sets a temperature of hot water and obtains hot water having the set temperature, the home appliance may satisfy user's various preferences.

Also, since the controller adjusts current of the heating device and the driving source so that total amounts of current value of the home appliance does not exceed a current limit value, an abnormal operation of the home appliance and power failure phenomenon may be prevented.

BRIEF DESCRIPTION OF DRAWINGS

FIG. 1 is a schematic view of a water purifier according to a first embodiment.

FIG. 2 is a perspective view of an instantaneous water heater and a controller according to the first embodiment.

FIG. 3 is a rear view of the instantaneous water heater of FIG. 2,

FIG. 4 is an exploded perspective view of the instantaneous water heater of FIG. 2.

FIG. 5 is a view of a flow path guide according to the first embodiment.

FIG. 6 is a block diagram of the water purifier according to the first embodiment.

FIG. 7 is a view illustrating change of current according to time in a water purifier according to the first embodiment.

FIG. 8 is a block diagram of a water purifier according to a second embodiment.

FIG. 9 is a view of an instantaneous water heater according to a third embodiment.

FIG. 10 is a front view of a heating flow path part according to the third embodiment.

FIG. 11 is a cross-sectional view taken along line A-A of FIG. 10.

FIG. 12 is a front view of a heating flow path part according to a fourth embodiment.

FIG. 13 is a front view of a heating flow path part according to a fifth embodiment.

FIG. 14 is a front view of a heating flow path part according to a sixth embodiment.

MODE FOR THE INVENTION

Hereinafter, exemplary embodiments of the present disclosure will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

FIG. 1 is a schematic view illustrating a water purifier as an example of a home appliance according to a first embodiment, FIG. 2 is a perspective view of an instantaneous water heater and a controller according to the first embodiment, FIG. 3 is a rear view of the instantaneous water heater of FIG. 2, FIG. 4 is an exploded perspective view of the instantaneous water heater of FIG. 2, and FIG. 5 is a view illustrating a flow path guide according to the first embodiment.

Referring to FIGS. 1 to 5, a water purifier 1 according to a first embodiment may include a housing 10 defining an outer appearance.

The housing 10 may include a plurality of panels. The housing may be manufactured by coupling the plurality of panels to each other. For example, the housing 10 may include a front panel, two side panels, a top panel, a rear panel, and a bottom panel, however, it should be noted that the present disclosure is not limited to the number of the plurality of panels.

Also, the housing 10 may include an input part 15 for inputting an operation command at the front panel thereof.

The input part 15 may include a purified water selection part for selecting dispense of purified water, a hot water selection part for selecting dispense of hot water, and a temperature selection part for selecting the temperature of the dispensed hot water.

The water purifier 1 may further include a manipulation lever 16 for manipulating the dispense of the purified water or hot water.

The water purifier 1 may further include a filtration part 20 for purifying water supplied from the outside and a purifying flow path 31 through which the water flows after passing through the filtration part 20. The filtration part 20 may include one or more filters.

The purifying flow path 31 may be divided into a first flow path 32 and a second flow path 33.

The second flow path 33 may be connected to a dispensing port 35 for dispensing water to the outside of the water purifier 1. Water to be heated may flow through the first flow path 32.

The water purifier 1 may further include an instantaneous water heater 50 which heats the water supplied from the first flow path 32 to change the water into hot water while the water flows and a controller 80 controlling the instantaneous water heater 50.

The instantaneous water heater 50 may include a heating flow path part 60 defining a heating flow path 66 through which heated water flows and a heating device 70 for heating water flowing through the heating flow path 66.

The heating device 70 may include a frame 710 and a coil part 730 seated on the frame 710.

The controller 80 may be disposed adjacent to the instantaneous water heater 50. A shield plate 90 for preventing the controller 80 from being affected by a magnetic field of the coil part 730 may be disposed between the controller 80 and the instaneous water heater 50.

The frame 710 may include a ferrite seat part 712 on which ferrites 720 are seated. The ferrite seat part 712 may be defined in such a way that a portion of the frame 710 is recessed. Alternatively, the ferrite seat part 712 may be defined by a plurality of ribs formed on the frame 710. Holes 713 may be defined in the ferrite seat part 712.

An opening 711 may be defined in a central portion of the frame 710. Also, a plurality of ferrite seat parts 712 may be disposed along a circumference of the opening 711.

An overheat detection sensor 740 to detect the temperature of the heating flow path part 60 may be disposed in the opening 711. That is, the overheat detection sensor 740 may be disposed within a region defined by a coil. The overheat detection sensor 740 may contact the heating flow path part 60 or may be spaced apart from the heating flow path part 60.

The controller 80 may stop the operation of the heating device 70 when a temperature detected from the overheat detection sensor 740 exceeds a reference temperature in order to prevent the heating flow path part 60 from being heated in a state in which no water exists in the heating flow path part 60. That is, the controller 80 may block current applied to the coil part 730.

The frame 710 may include a plurality of contact ribs 714 contacting a periphery of the coil part 730 in order to prevent the position of the coil part 730 seated on the ferrite 720 from being changed.

The coil part 730 has a structure in which coils are wound multiple times and stacked in multilayers. When the coil constituting the coil part 730 is provided in a single layer, the frame 710 on which the coil part 730 is disposed increases in size, and thus, a total size of the heating device may increase. However, according to the present disclosure, since the coils are stacked in multilayers, region occupied by the coil part 730 may decrease. Thus, the heating device may be compact.

Here, each of the plurality of contact ribs 714 may have a height that is equal to or greater than the stacked height of the coil part 730.

The frame 710 may further include one or more coupling ribs 715 coupled to the heating flow path part 60. The one or more coupling ribs 715 may include a hooking part hooked to the heating flow path part 60. Alternatively, the coupling ribs 715 may be fastened to the heating flow path part 60 by a fastening member.

The coil part 730 may be have a circular ring or an elliptical ring. Of course, the coil part 730 may be have a polygonal ring shape.

The coil part 730 may include an input end 731 and an output end 732. At least one of the input end 731 and the output end 732 may pass through the opening 711. FIG. 3 illustrates, for example, that the output end 732 passes through the opening 711.

The heating flow path part 60 may include a first guide 61 including an inflow part 63 for introducing water to be heated and a discharge part 64 for discharging heated water (hot water), and a second guide 62 defining a heating flow path 66 together with the first guide 61.

The second guide 62 may be a magnetic substance so as to be inductively heated.

The first guide 61 may be a non-magnetic substance so as not to be inductively heated. Of course, both of the first and second guide 61 and 62 may be magnetic substances.

When current is applied to the coil part 730, a magnetic field is generated at the coil part 730, and current is generated by the magnetic field, and the second guide is heated.

The coil part 730 may be spaced a predetermined distance from the heating flow path part 62. In order that the coil part 730 may be spaced a predetermined distance apart from the heating flow path part 62, the frame may include a spacer 717. The spacer 717 may contact the second guide 62 while the heating device is coupled to the heating flow path part 60.

The heating flow path 60 may be disposed such that the discharge part 64 is positioned higher than the inflow part 63 in the water purifier 1.

Accordingly, since water introduced into the heating flow path 66 should upwardly flow to the discharge part 64, water flowing through the heating flow path 66 may be sufficiently heated.

According to the present embodiment, water flowing through the heating flow path 66 defined by the second guide 62 may be heated by the second guide 62. Here, the entire second guide 62 may be heated, and the water in the heating flow path 66 may be quickly heated.

Also, there is no temperature rise adjacent to the heating flow path 60 because the surface of the second guide 62 generates heat. Therefore, there is a merit in that the insulation of the heating flow path is not required.

Also, since the water flowing through the heating flow path 66 is instantaneously heated, there is a merit in that standby electric power for storing and maintaining the temperature of hot water is not required.

Also, the discharge part 64 may be connected to the second flow path 33 through the third flow path 34.

The heating flow path 66 may include a flow path guide 65 such that water may uniformly flow in the heating flow path 66.

The flow path guide 65 may be disposed in a direction crossing a direction of water flow in the heating flow path 66. Also, the flow path guide 65 may be disposed more adjacent to the discharge part 64 than the inflow part 63. However, in the present embodiment, the position of the flow path guide 65 is not limited thereto.

The flow path guide 65 may include a plurality of holes 652, 653, and 654 through which water passes. The plurality of holes 652, 653, and 654 may be disposed in a direction crossing a direction of water flow in the heating flow path 66. Also, the sizes of the plurality of holes 652, 653, and 654 may be different.

The plurality of holes 652, 653, and 654 may include a first hole 652 with a first size, a second hole 653 with a second size smaller than the first size, and one or more third holes 654 positioned between the first and second holes 652 and 653. The one or more third holes 654 may have sizes equal to the size of any one of the first and second holes 652 and 653, or have different sizes from those of the first and second holes 652 and 653. In the present embodiment, one or more third holes may not be provided in the flow path guide.

The first hole 652 may be positioned adjacent to an end portion of the flow path guide 65, and the second hole 653 may be positioned adjacent to a central portion of the flow path guide 65. Also, the second hole 653 may be positioned more adjacent to the discharge part 64 than the first hole 652.

Accordingly, since the flow resistance of the second holes 653 with a small size is greater than that of the first hole 652 in the heating flow path 66, water is prevented from being concentrated to the second holes 653. Thus, water may uniformly flow through the entire heating flow path 66.

When water uniformly flows in the heating flow path 66, heating time of water may be reduced since the contact time of the water and the second guide 62 is increased.

As another example, one or more of the first and second guides 61 and 62 may include flow path guides formed therein. In this case, the flow path guide may extend in a direction crossing the flow direction of water at a position adjacent to the discharge part 64.

The first flow path 32 may include a first valve 41 for adjusting water flow. A second valve 42 for adjusting water flow may be disposed between a position to which the third flow path 34 is connected in the second flow path 33 and a position at which the third flow path 33 meets the first flow path 32.

The water purifier 1 may further include an inflow-water temperature sensor 91 disposed at the first flow path 32 and detecting the temperature of water to be introduced to the heating flow path part 60, and an discharge-water temperature sensor 92 disposed at the third flow path 34 and detecting the temperature of water discharged from the heating flow path part 60. As another example, the inflow-water temperature sensor 91 may be disposed at an inflow part 63 of the heating flow path part 60, and the discharge-water temperature sensor may be disposed at a discharge part 64 of the heating flow path part 60.

FIG. 6 is a block diagram of a water purifier according to the first embodiment.

Referring to FIG. 6, the water purifier 1 may further include a flow rate sensor 83 detecting a flow rate of water flowing through the heating flow path part 60, and a driving source 95 controlled by the controller 80.

Although the driving source 95 is not limited thereto, the driving source 95 may include a compressor, a display part, etc., and may include all components operating by receiving current except for the instantaneous water heater in the water purifier 1.

The controller 80 may include an inverter 81 adjusting current applied to the coil part 730.

The inverter 81 may adjust an amount of inductive heating by changing the current applied to the coil part 730. When the amount of inductive heating is thus adjusted, water may be heated to a temperature desired by a user, and hot water with a temperature desired by a user may be dispensed from the dispensing port 35.

FIG. 7 is a view illustrating a change in current according to time in a water purifier according to the first embodiment.

Referring to FIG. 7, the controller 80 may adjust current of the entire water purifier 1.

Specifically, the controller 80 may adjust the current of the driving source 95 according to whether the heating device 70 operates. The controller 80 may control the total current value A2 of the water purifier 1 not to exceed a current limit value A1.

When the heating device 70 operates while the driving source 95 operates, the case in which the current of the water purifier 1 exceeds the current limit value A1 may occur. In this case, the water purifier 1 abnormally operates or the power of the water purifier may be turned off.

Accordingly, in the present disclosure, when the heating device 70 operates, the total current value A2 of the water purifier 1 becomes lower than the current limit value A1 in such a way that the controller 80 adjusts the current of the driving source 95 based on the current of the heating device 70.

For example, the current of the heating device 70 may be changed such that when the current of the heating device 70 is increased, the controller 80 lowers the current of the driving source 95, and when the current of the heating device 70 is decreased, the controller 80 increases the current of the driving source 95.

Hereinafter, with reference to FIGS. 1 to 6, the process in which purifier water and hot water are dispensed from the water purifier will be described.

First, the process of dispensing purified water will be described.

When a purified water dispense command is inputted (for example, when the purified water selection part is selected, and the manipulation lever 16 operates), the first valve 41 is turned off and the valve 42 is turned on. Then, purified water purified by the filtration part 20 is discharged through the dispensing port 35 after flowing through the purifying flow path 31 and the second flow path 33.

Next, the process of dispensing hot water will be described.

When a hot water dispense command is inputted (for example, when the hot water selection part is selected, and the manipulation lever 16 operates), the second valve 42 may be turned off, the first valve 42 may be turned on, and the heating device 70 operates.

The controller 80 determines current applied to the coil part in an initial stage of the operation of the heating device 70 based on a flow rate detected from the flow rate sensor 83 and a temperature detected from the inflow-water temperature sensor 91, and supplies the determined current to the coil part 730.

Here, when water exists in the heating flow path 66, the first valve 41 may be turned on while the heating device operates after the hot water dispense command is inputted. On the contrary, when water does not exist in the heating flow path 66, the first valve 41 may be turned on, and when the heating flow path 66 is filled with water, the first valve may be turned off. Also, the heating of water and the discharge of heated water (hot water) may be adjusted through the adjustment of flow rate by the first valve 41.

Purified water purified by the filtration part 20 is introduced to the heating flow path of the heating flow path part 60 through the inflow part 63 after flowing through the first flow path. When the heating device 70 operates, the second guide 62 is heated, and water flowing along the heating flow path 66 is heated by the second guide 62 to be changed into hot water. Further, the hot water flows to the third flow path 34 through the discharge part 64. Then, the hot water is finally discharged through the dispensing port 35.

A user may set a temperature of hot water to be dispensed by using the temperature selection part. While the heating device 70 operates, the discharge-water temperature sensor 93 detects the temperature of hot water, and the controller 80 adjusts current supplied to the coil part 730 such that the detected temperature is equal to the set temperature.

Thus, according to the present embodiment, since a user may set a temperature of hot water and obtain hot water with the set temperature, there is a merit of satisfying user's various preferences.

FIG. 8 is a block diagram of a water purifier according to a second embodiment.

The present embodiment is the same as the first embodiment except for being characterized in that the flow rate of water flowing to the heating device may be adjusted. Accordingly, only a characterized portion in the present embodiment will be described below.

Referring to FIG. 8, the controller 80 determines a flow rate to flow to the heating flow path part 60 in an initial stage of the operation of the heating device 70 based on a temperature detected from the inflow-water temperature sensor 91, and controls the first valve 41 such that water with the determined flow rate is supplied to the heating flow path part 60.

For example, when the temperature detected from the inflow-water temperature sensor 91 is high, the controller 80 controls the first valve 41 such that the flow rate of water flowing to the heating flow path part 60 may be greater. On the contrary, when the temperature detected from the inflow-water temperature sensor 91 is low, the controller 80 controls the first valve 41 such that the flow rate of water flowing to the heating flow path part 60 may be smaller.

Also, water with the determined flow rate is heated while flowing through the heating flow path part 60.

A user may set a temperature of hot water to be dispensed by using the temperature selection part.

While the heating device 70 operates, the discharge-water temperature sensor 93 detects the temperature of hot water, and the controller 80 adjusts current supplied to the coil part 730 such that the detected temperature of the hot water is equal to the set temperature.

In addition, in the present disclosure, steam may be generated at the heating flow path part 60 by adjusting a flow rate of water flowing through the heating flow path part 60 and current applied to the coil part 730. The steam generated from the heating flow path part 60 may be discharged through the dispensing port 35, and through this process, the sterilization of flow paths from the heating flow path part 60 to the dispensing port 35 may be performed.

In the above two embodiments, current supplied to the coil part is determined at an initial stage of the operation of the heating device 70 based on a temperature detected from the inflow-water temperature sensor 91 and a flow rate detected from the flow rate sensor 83. However, alternatively, the inflow-water temperature sensor and the flow rate sensor are not provided, current with a predetermined amount is supplied to the coil part at the initial stage of the operation of the heating device, and current supplied to the coil part may be adjusted based on the temperature of hot water detected from the discharge-water temperature sensor.

Also, in the above two embodiments, although it is described that the heating device is positioned at one side of the heating flow path part, alternatively, heating devices may be respectively disposed at both sides of the heating flow path part.

Also, in the above two embodiments, although it is described that the instantaneous water heater is disposed in the water purifier, alternatively, the inventive concept of the present disclosure may be applied to home appliances including water dispensing function. For example, components such as the instantaneous water heater, the filtration part, the above-mentioned flow path of water, the valve, the sensor, and the inflow part, may also be disposed the same to a refrigerator. In this case, the instantaneous water heater may be disposed, for example, at a frame of a refrigerator door or at a body including storage compartment.

FIG. 9 is a view of an instantaneous water heater according to a third embodiment, FIG. 10 is a front view of a heating flow path part according to the third embodiment, and FIG. 11 is a cross-sectional view taken along line A-A of FIG. 10.

The present embodiment is the same as the first embodiment except for the flow path guide in the heating flow path part. Thus, only portions characterized in the present embodiment will be described below, and the same portions as the first embodiment will be described by using the description of the first embodiment.

Referring to FIGS. 9 to 11, an instantaneous water heater 71 according to the present embodiment may include a heater flow path part 60.

The heating flow path part 60 may include a first guide 61 including an inflow part 63 and a discharge part 64 for discharging heated water (hot water), and a second guide 62 defining a heating flow path 66 with the first guide 61.

The first guide 61 may include a flow path guide 612 for guiding water flow in the heating flow path 66.

The flow path guide 612 may be defined such that a portion of the first guide 61 is formed by a forming process. For example, the flow path guide 612 may be formed such that a portion of the first guide 61 protrudes toward the second guide 62.

The flow path guide 612 may be function as the flow resistance of water between the inflow part 63 and the discharge part 64.

That is, at least one portion of water introduced through the inflow part 63 may flow to detour around the flow path guide 612 by the flow path guide 612.

The flow path guide 612 may be function to prevent the water introduced through the inflow part 63 from directly flowing to the discharge part 64. For this, at least a portion of the flow path guide 612 may be disposed to face the inflow part 63. Accordingly, at least one portion of the water introduced into the heating flow path 66 through the inflow part 63 have a flow direction which may be changed by the flow path guide 612.

For example, at least a portion of the flow path guide 612 may be disposed on a line connecting the inflow part 63 and the discharge part 64.

Here, the flow path guide 612 may extend from the first guide 61 toward the second guide 62, and may be spaced apart from the second guide 62. That is, the flow path guide 612 may not contact the second guide 62.

According to the present embodiment, since the flow path guide 612 is spaced apart from the second guide 62, heat loss due to the transfer of the heat generated such that the second guide 62 is heated by the current flowing through the coil part 730 may be prevented.

That is, according to the present embodiment, a portion of the heat generated from the second guide 62 may be transferred to the first guide 61 contacting the second guide 62, and the other portion may be transferred to the water between the first and second guides 61 and 62.

When the flow path guide 612 contacts the second guide 62, although heat loss may be generated such that a portion of the heat of the second guide 62 is transferred not to water but directly to the flow path guide 612, the heat loss may be prevented because the flow path guide 612 is spaced apart from the second guide according to the present embodiment.

Here, the distance D2 between the flow path guide 612 and the second guide 62 may be smaller than a half of the distance D1 between the first guide 61 and the second guide 62. According to this structure, the heat loss due to the flow path guide 612 is prevented, and simultaneously, the flow path guide 612 may function as flow path resistance.

The coil part 730 may have a ring shape as described above. In this case, the coil part 730 has an opening 732 in which no coil exists.

Also, the coil part 730 and the heating flow path part 60 may face each other. That is, the heating flow path part 60, that is, each of the first and second guides 61 and 62 may include a first portion 611*a* facing the coil part 730 and a second portion 611*b* not facing the coil part 730.

Here, the temperature of the second portion 611*b* facing the opening 732 is lower than that of the first portion 611*a* facing the coil part 730. Accordingly, water introduced through the inflow part 63 preferably flows along the first portion 611*a* facing the coil part 730.

For this, the flow path guide 612 may be positioned between the second portion 611*b* and the inflow part 63 in the first guide 61. Here, the inflow part 63, the flow path guide 612, and the second portion 611*b* may be positioned on one straight line.

Accordingly, while flowing upward, the water introduced through the inflow part 63 may flow to branch into both sides of the flow path guide 612 by the flow path guide 612.

Of course, although water may also exist at a side of the second portion 611*b*, and water flow exists, the water may flow upward affected by flow of the water flowing along the first portion 611*a*.

According to a proposed embodiment, since the water introduced through the inflow part 63 is prevented from directly flowing to the discharge part 64 by the flow path guide 612, there is a merit in that the water may be entirely heated in the heating flow path.

Also, since the water may uniformly flow in the heating flow path, the generation of steam at one position in the heating flow path due to a local overheat may be prevented.

FIG. 12 is a front view of a heating flow path part according to a fourth embodiment.

The present embodiment is the same as the third embodiment except for a flow path guide in a heating flow path part. Thus, only portions characterized in the present embodiment will be described below, and the same portions as the third embodiment will be described by using the description of the third embodiment.

Referring to FIG. 12, a first guide 61 of the present embodiment may include a plurality of flow path guides 612 and 615.

The plurality of flow path guides 612 and 615 may be disposed to be spaced apart from each other in a direction parallel to a flow direction of water between the inflow part 63 and the discharge part 64.

The plurality of flow path guides 612 and 615 may include a first flow path guide 612 and a second flow path guide 615 disposed between the first flow path guide 612 and the discharge part 64.

Since the shape and position of the first flow path guide 612 may be the same as the flow path guide 612 described in the third embodiment, detailed descriptions will not be provided.

The second flow path guide 615 may guide the flow of water such that the water may entirely flow in the heating flow path 66 adjacent to the discharge part 64.

At least a portion of the second flow path guide 615 may be positioned on a line connecting the first flow path guide 612 and the discharge part 64.

Also, at least a portion of the second flow path guide 615 may be disposed between the discharge part 64 and the second portion 611*b*.

Also, the first and second flow path guides 612 and 615 may face the coil part 730.

According to the present embodiment, the first flow path guide 612 may guide the flow of water such that the water introduced through the inflow part 63 may flow along the first portion 611*a* facing the coil part 730.

The second flow path guide 615 may prevent the water flowing to the discharge part 64 in the heating flow path 66 from being concentrated adjacent to the discharge part 64. That is, since the water may flow to detour around the discharge part 64 in the heating flow path 66, there is a merit in that a local overheat at both sides of the discharge part 64 may be reduced.

Although it is described in the above embodiment that the first guide 61 includes the first and second flow path guides 612 and 615, alternatively, the first guide 61 may include only the second flow path guide 615.

FIG. 13 is a front view of a heating flow path part according to a fifth embodiment.

The present embodiment is the same as the fourth embodiment except for a flow path guide in a heating flow path part. Thus, only portions characterized in the present embodiment will be described below, and the same portions as the fourth embodiment will be described by using the description of the fourth embodiment.

Referring to FIG. 13, a first guide 61 of the present embodiment may include a plurality of flow path guides 612 to 617.

The plurality of flow path guides 612 to 617 may include a plurality of first flow path guides 612, 613, and 614, and a plurality of second flow path guides 615, 616, and 617 disposed at a region between the first flow path guides 612, 613, and 614 and the discharge part 64.

The plurality of first flow path guides 612, 613, and 614 may be disposed in a direction crossing the direction of water flow between the inflow part 63 and the discharge part 64.

The plurality of second flow path guides 615, 616, and 617 may be disposed in a direction crossing the direction of water flow between the inflow part 63 and the discharge part 64.

At least a portion of the plurality of first flow path guides 612, 613, and 614 may be disposed on a line connecting the inflow part 63 and the discharge part 64.

Also, at least a portion of the plurality of second flow path guides 615, 616, and 617 may be disposed on a line connecting the inflow part 63 and the discharge part 64.

The plurality of first flow path guides 612, 613, and 614 may guide the flow of water such that the water introduced through the inflow part 63 may flow to be entirely distributed in the heating flow path 66.

The plurality of first flow path guides 612, 613, and 614 may guide the flow of water such that the water may flow along the first portion 611*a* facing the coil part.

Each of the plurality of first flow path guides 612, 613, and 614 may be spaced apart from a side surface portion 67 of the heating flow path part 60.

The first guide 61 may include a third portion 611*c* which does not face an opening 732, in the second portion 611*b* which does not face the coil part 730. In the present embodiment, in order to minimize an amount of the water introduced through the inflow part 63 and flowing to the third portion 611*c*, the distance between two adjacent flow path guides may be greater than the distance between one of the flow path guides 613 and 614 adjacent to a side surface portion 67 of the heating flow path part 60 and the surface portion 67 of the heating flow path part 60.

The plurality of second flow path guides 615, 616, and 617 may prevent the water upwardly flowing in the heating flow path 66 from being concentrated at the side of the discharge part 64.

Each of the plurality of second flow path guides 615, 616, and 617 may be spaced apart from a side surface portion 67 of the heating flow path part 60. The distance between two adjacent second flow path guides may be greater than the distance between one of the flow path guides 616 and 617 adjacent to a side surface portion 67 of the heating flow path part 60 and the surface portion 67 of the heating flow path part 60.

FIG. 14 is a front view of a heating flow path part according to a sixth embodiment.

The present embodiment is the same as the fifth embodiment except for a flow path guide in a heating flow path part. Thus, only portions characterized in the present embodiment will be described below, and the same portions as the fifth embodiment will be described by using the description of the fifth embodiment.

Referring to FIG. 14, a heating flow path part 60 of the present embodiment may further include a corner parts 61*d* and 61*e* which are rounded or inclined.

The corner parts 61*d* and 61*e* may include a pair of corner parts 61*d* disposed such that the area of the heating flow path 66 is gradually increased in a direction from the inflow part 63 toward the discharge part 64.

The corner parts 61*d* and 61*e* may further include a pair of corner parts 61*e* disposed such that the area of the heating flow path 66 is gradually decreased in a direction from the inflow part 63 toward the discharge part 64.

Here, a heating flow path between the first and second corner parts 61*d* and 61*e* in the heating flow path 66 may be constant with respect to the direction of water flow, and have a maximum width.

Also, the inflow part 63 may be disposed between the pair of first corner parts 61*d*, and the discharge part 64 may be disposed between the pair of second corner parts 61*e*.

According to the present embodiment, the water introduced through the inflow part 63 may be entirely distributed by the first corner part 61*d* and flow to the discharge part 64.

Also, since water does not stay at the second corner part 61*e* but flows along the second corner part 61*e* toward the discharge part 64, water may be prevented from being locally overheated at the second corner part 61*e*.

Although it is illustrated that the heating flow path part 60 includes the first and second corner parts which are rounded or inclined, alternatively, the heating flow path part 60 includes only the second corner part which is rounded or inclined. In this case, the second corner part may be disposed such that the area of the heating flow path is gradually decreased as becoming further from the inflow part 63.

The invention claimed is:

1. A home appliance comprising:

a dispensing port;

a heating flow path part communicated with the dispensing port;

a heating device configured to heat water flowing through the heating flow path part; and a controller configured to control the heating device, wherein the heating device comprises a coil part in which coils are stacked in multilayers, wherein the coil part is provided outside of the heating flow path part, wherein the coil part is spaced a predetermined distance from the heating flow path part, wherein the coil part and the heating flow path part face each other, and wherein the at least one portion of the heating flow path part is a magnetic substance.

2. The home appliance according to claim 1, wherein the heating device comprises a frame on which the coil part is seated, and the frame is coupled to the heating flow path part.

3. The home appliance according to claim 2, wherein the frame comprises a spacer spacing the heating flow path part from the coil part by a predetermined distance.

4. The home appliance according to claim 2, further comprising a sensor to detect a temperature of the heating flow path part, wherein the sensor is disposed within a region defined by the coil part.

5. The home appliance according to claim 4, wherein the frame comprises an opening through which at least one of an input end or an output end of the coil part pass, and the sensor is disposed in the opening.

6. The home appliance according to claim 1, wherein the heating flow path part comprises:

a first guide comprising an inflow part and a discharge part; and a second guide coupled to the first guide and defining a heating flow path through which water flows together with the first guide, and wherein the second guide is a magnetic substance.

7. The home appliance according to claim 1, further comprising:

an input part to receive an input identifying a temperature of water dispensed from the dispensing port; and wherein the controller configured to adjust current applied to the coil part according to the temperature inputted through the input part.

8. The home appliance according to claim 7, further comprising a discharge-water temperature sensor to detect a temperature of hot water discharged from the heating flow path part, wherein the controller adjusts the current applied to the coil part so that the temperature inputted from the input part is the same as the temperature detected from the discharge-water temperature sensor.

9. The home appliance according to claim 7, further comprising an driving source operating by receiving current, wherein the controller controls current of the driving source according to the current supplied to the heating device.

10. The home appliance according to claim 7, further comprising:

an inflow-water temperature sensor to detect a temperature of water supplied to the heating flow path part;

a flow rate sensor to detect a flow rate of the water supplied to the heating flow path part; and a discharge-water temperature sensor to detect a temperature of hot water discharged from the heating flow path part, wherein, in an initial operation stage of the heating device, the controller determines a current value to be supplied to the coil part on the basis of information detected from the inflow-water temperature sensor and the flow rate sensor to apply the determined current value, and while the heating device operates, the controller adjusts current supplied to the coil part on the basis of the temperature detected from the discharge-water temperature sensor.

11. The home appliance according to claim 7, further comprising:

an inflow-water temperature sensor to detect a temperature of water supplied to the heating flow path part; and a valve to adjust a flow rate of water supplied to the heating flow path part, wherein, in an initial operation stage of the heating device, the controller determines a flow rate of water to be supplied to the heating flow path part on the basis of a temperature of water detected from the inflow-water temperature sensor to control the valve so that the determined flow rate of water is supplied to the heating flow path part.

12. The home appliance according to claim 7, further comprising a discharge-water temperature sensor to detect a temperature of hot water discharged from the heating flow path part, wherein, in an initial operation stage of the heating device, the controller supplies a preset amount of current to the coil part, and while the heating device operates, the controller adjusts current applied to the coil part according to the temperature detected in the discharge-water temperature sensor.

13. The home appliance according to claim 7, wherein the controller is disposed on one side of the heating device, and a shield plate for preventing the controller from being affected by a magnetic field of the coil part is disposed between the heating device and the controller.

14. A home appliance comprising:

a dispensing port;

a heating flow path part communicated with the dispensing port;

a heating device configured to heat water flowing through the heating flow path part; and a controller configured to control the heating device, wherein the heating flow path part comprises:

an inflow part to which water is introduced;

a discharge part from which the heated water is discharged; and a heating flow path to connect the inflow part to the discharge part, wherein a flow path guide for guiding flow of the water is disposed in the heating flow path so that the water uniformly flows between the inflow part and the discharge part, and wherein the flow path guide comprises a plurality of holes through which the water passes, and the plurality of holes are arranged in a direction crossing a direction in which the water flows in the heating flow path.

15. The home appliance according to claim 14, wherein the plurality of holes comprises:

a first hole defined adjacent to an end of the flow path guide; and a second hole defined adjacent to a central side of the flow path guide, the second hole has a size different from that of the first hole.

16. The home appliance according to claim 15, wherein the second hole is defined adjacent to the discharge part when compared to the first hole.

17. The home appliance according to claim 14, wherein the flow path guide is disposed adjacent to the discharge part when compared to the inflow part.

18. The home appliance according to claim 14, wherein the flow path guide is defined in the heating flow path part by a forming process.

19. The home appliance according to claim 14, wherein the heating flow path part comprises:

a first guide; and a second guide defining the heating flow path together with the first guide, and the flow path guide extends from the first guide toward the second guide and is spaced apart from the second guide.

20. The home appliance according to claim 14, wherein the flow path guide is disposed on a line connecting the inflow part to the discharge part in the heating flow path so as to change a flow direction of the water introduced from the inflow part.

21. The home appliance according to claim 14, wherein the heating device comprises a coil part having a ring shape, and the heating flow path part comprises:

a first portion facing the coil part; and a second portion not facing the coil part, and the flow path guide guides the flow of the water so that the water introduced from the inflow part flows toward the first portion.

22. The home appliance according to claim 21, wherein the flow path guide is disposed between the second portion and the inflow part.

23. The home appliance according to claim 14, wherein a plurality of flow path guides are disposed to be spaced apart from each other in a direction parallel to the flow direction of the water between the inflow part and the discharge part.

24. The home appliance according to claim 23, wherein the plurality of flow path guides comprise:

a first flow path guide; and a second flow path guide disposed in a region between the first flow path guide and the discharge part.

25. The home appliance according to claim 14, wherein a plurality of flow path guides are arranged in a direction crossing the flow direction of the water between the inflow part and the discharge part.

26. The home appliance according to claim 25, wherein a distance between two adjacent flow path guides is greater than a distance between one flow path guide adjacent to a side wall of the heating flow path part and a side wall of the heating flow path part.

27. The home appliance according to claim 14, wherein the heating flow path part comprises a pair of corner parts allowing the heating flow path to gradually decrease in section area as the heating flow path is away from the inflow part, and each of the pair of corner parts is rounded or inclined, and the discharge part is disposed between the pair of corner parts.

* * * * *